US010152016B2

(12) United States Patent
Koyanagi

(10) Patent No.: US 10,152,016 B2
(45) Date of Patent: Dec. 11, 2018

(54) IMAGE FORMING APPARATUS

(71) Applicant: CANON KABUSHIKI KAISHA, Tokyo (JP)

(72) Inventor: Noriaki Koyanagi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/297,613

(22) Filed: Oct. 19, 2016

(65) Prior Publication Data

US 2017/0131679 A1 May 11, 2017

(30) Foreign Application Priority Data

Nov. 11, 2015 (JP) ..... 2015-220964

(51) Int. Cl.
*G03G 21/16* (2006.01)
*G03G 15/00* (2006.01)

(52) U.S. Cl.
CPC ..... *G03G 21/1638* (2013.01); *G03G 15/70* (2013.01); *G03G 21/1633* (2013.01)

(58) Field of Classification Search
CPC ..... G03G 21/1638
USPC ..... 399/21
See application file for complete search history.

(56) References Cited

U.S. PATENT DOCUMENTS 2,148,787 A * 2/1939 Thomas ..... F21V 33/00 362/309
3,141,398 A * 7/1964 Miller ..... G03B 27/06 355/80
5,790,374 A * 8/1998 Wong ..... G02B 6/0005 361/679.32
6,658,218 B2 * 12/2003 Krolczyk ..... B65H 43/00 399/16
7,092,646 B2 * 8/2006 Schroath ..... G03G 15/70 399/16
7,505,714 B2 * 3/2009 Asanuma ..... H04N 1/00519 347/104
7,529,518 B2 * 5/2009 Kubo ..... G03G 15/6552 399/18
8,699,065 B2 * 4/2014 Okada ..... G03G 15/5016 345/1.1
9,628,763 B2 * 4/2017 Andoh ..... H04N 9/00
2004/0213590 A1 * 10/2004 Schroath ..... G03G 15/70 399/21

(Continued)

FOREIGN PATENT DOCUMENTS

JP 2003-295546 A 10/2003
JP 2004-085887 A 3/2004

OTHER PUBLICATIONS

Office Action dated Sep. 21, 2018, in Chinese Patent Application No. 201610988668.0.

*Primary Examiner* — Anthony Nguyen
(74) *Attorney, Agent, or Firm* — Fitzpatrick, Cella, Harper & Scinto

(57) ABSTRACT

An image forming apparatus includes an apparatus body, an opening/closing portion, and a light emitting element. The apparatus body includes an image forming unit configured to form an image on a sheet. the light emitted by the light emitting element is visible from an exterior surface of the opening/closing portion in a state where the opening/closing portion is at the closed position and is visible from an opposite side, with respect to the exterior surface, of the opening/closing portion in a state where the opening/closing portion is at the open position.

16 Claims, 14 Drawing Sheets

(56) References Cited

U.S. PATENT DOCUMENTS

| | | | | |
|---|---|---|---|---|
| 2011/0079034 | A1* | 4/2011 | Kim | F25D 23/02 62/264 |
| 2012/0019861 | A1 | 1/2012 | Okada et al. | |
| 2013/0135646 | A1* | 5/2013 | Akiyama | G06F 3/12 358/1.13 |
| 2013/0302044 | A1* | 11/2013 | Yoshioka | G03G 21/1695 399/21 |
| 2014/0334834 | A1* | 11/2014 | Katsuyama | G03G 15/70 399/21 |

* cited by examiner 1
30
11
12
13
4
6
24
3
10
15
2
33
33
18
51
14
17
24
10
14
28
27
26b
59
26a
S

IMAGE FORMING APPARATUS

BACKGROUND OF THE INVENTION

Field of the Invention

The present invention relates to an image forming apparatus configured to form an image on a sheet.

Description of the Related Art

An image forming apparatus, e.g. a copier, that includes a plurality of functional units such as a feeding unit, a sheet feeding unit, a fixing unit, and a discharge unit is generally known. In such an image forming apparatus, sometimes an abnormality such as a paper jam may occur at any of the functional units during image formation operation. The paper jam will be hereinafter referred to as a jam. To address the case above, Japanese Unexamined Patent Application Publication No. 2003-295546 proposes an image forming apparatus that, in the case where such a jam has occurred, notifies a user of a portion where the jam has occurred such that the user can easily remove the jam. This image forming apparatus includes light emitting diodes, i.e. LEDs, provided at positions in a cover body of the apparatus corresponding to respective functional units, and notifies an operator of occurrence of a jam by lighting one of the LEDs when the jam has occurred.

Generally, in an image forming apparatus, removal of a jam cannot be efficiently performed unless removal of an abnormality is performed in an appropriate order by following a guidance displayed by lighting of the LEDs. An image forming apparatus described in Japanese Unexamined Patent Application Publication No. 2003-295546 includes LEDs provided at a door and a conveyance guide so as to notify the user of a presence of a sheet in a conveyance path and notifies a user of a position of a jam having occurred during image formation.

However, in the case where the user opens the guide or the door at a position where the jam has occurred, the LEDs provided at the guide and the door go behind the guide and the door and thus becomes invisible. Therefore, even if the completion of jam removal is notified by putting off the light of LEDs, the user cannot check the LEDs in a state where the guide or the door is open. In this case, the user has to check the state of the jam removal via, for example, a display of an operation portion, and this is not preferable in terms of operability.

SUMMARY OF THE INVENTION

According to an aspect of the present invention, an image forming apparatus includes an apparatus body, an opening/closing portion, and a light emitting element. The apparatus body includes an image forming unit configured to form an image on a sheet. Theopening/closing portion is openably and closably supported by the apparatus body between an open position and a closed position. The light emitting element is configured to emit light and is mounted to the opening/closing portion such that the light emitted by the light emitting element is visible from an exterior surface of the opening/closing portion in a state where the opening/closing portion is at the closed position and is visible from an opposite side, with respect to the exterior surface, of the opening/closing portion in a state where the opening/closing portion is at the open position.

Further features of the present invention will become apparent from the following description of exemplary embodiments with reference to the attached drawings.

DESCRIPTION OF THE EMBODIMENTS

First Exemplary Embodiment

Figure 1:
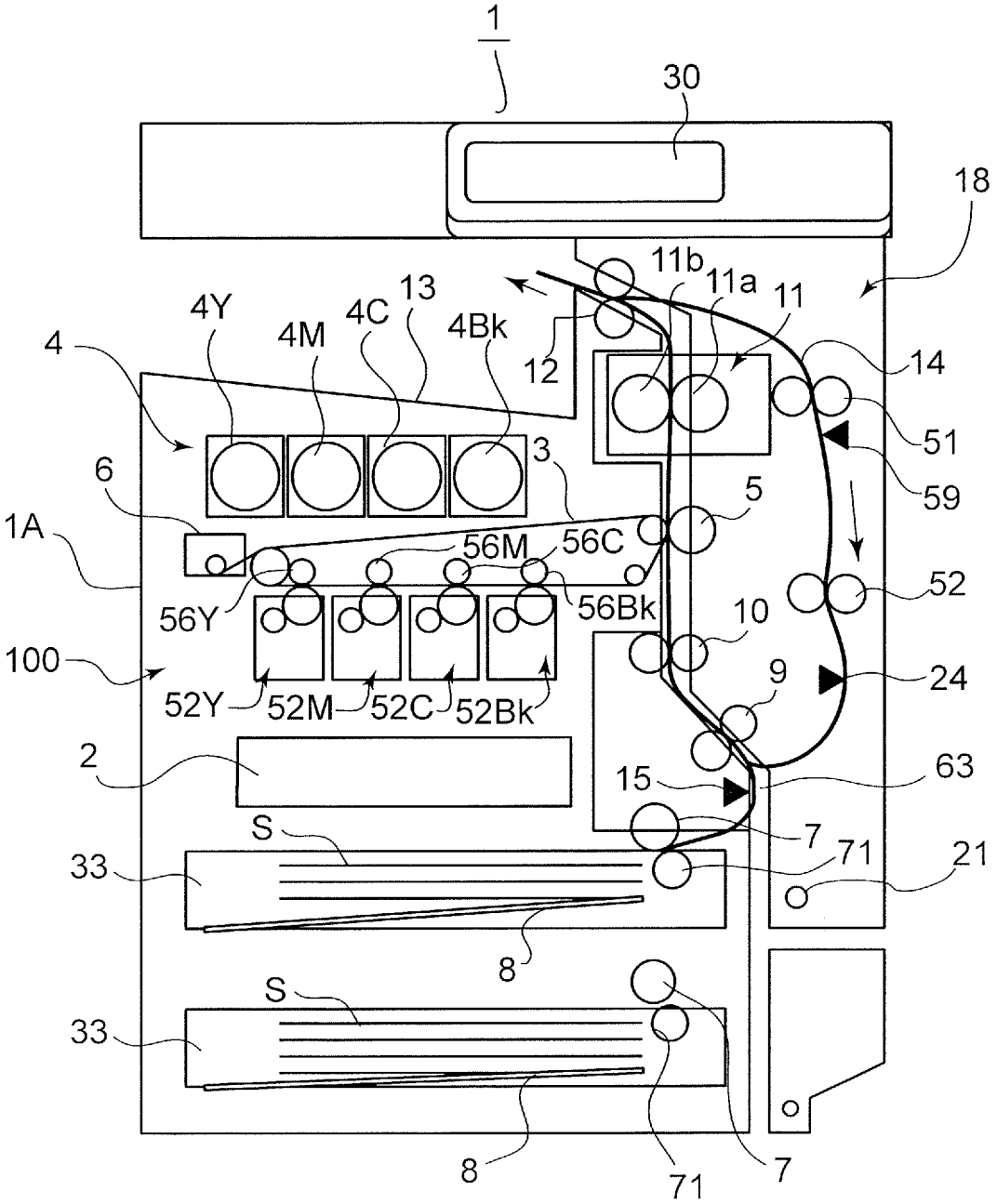
FIG. 1 is a schematic view of an overall structure of a printer according to a first exemplary embodiment.

First, a first exemplary embodiment according to the present invention will be described. A printer 1 serving as an image forming apparatus according to the first exemplary embodiment is a laser beam printer using an electrophotographic system. As illustrated in FIG. 1, the printer 1 includes an apparatus body 1A, two-tiered cassettes 33, and a fixing unit 11. The apparatus body 1A houses an image forming unit 100 serving as an image forming unit. The cassettes 33 are provided so as to be attachable to and detachable from the apparatus body 1A. In addition, the printer 1 includes a duplex conveyance unit 18 supported by the apparatus body 1A so as to be openable and closable. The duplex conveyance unit 18 serves as an opening/closing portion.

Once an instruction to perform image formation is input to the printer 1, the image forming unit 100 starts an image formation process on the basis of image information input from, for example, an external computer connected to the printer 1. The image forming unit 100 includes a laser scanner 2 and four process cartridges 52Y, 52M, 52C, and 52Bk that form images of four colors of yellow, magenta, cyan, and black. Y, M, C, and Bk respectively correspond to yellow, magenta, cyan, and black. The four process cartridges 52Y, 52M, 52C, and 52Bk form images of different colors, but have the same configuration as each other except for the colors of the formed images. Therefore, just image formation process of the process cartridge 52Y will be described below and descriptions concerning the process cartridges 52M, 52C and 52Bk will be omitted.

The laser scanner 2 irradiates a photosensitive drum of the process cartridge 52Y with laser light on the basis of the input image information. At this time, the photosensitive drum has been electrified beforehand by an electrifying roller that is not illustrated, and an electrostatic latent image is formed on the photosensitive drum as a result of the photosensitive drum being irradiated with the laser light. Then, the electrostatic latent image is developed by a developing roller, and a yellow toner image is formed on the photosensitive drum.

In the same way, toner images of magenta, cyan, and black are respectively formed on photosensitive drums of the process cartridges 52M, 52C, and 52Bk. The toner images of respective colors formed on corresponding photosensitive drums are transferred onto an intermediate transfer belt 3 by primary transfer rollers 56Y, 56M, 56C, and 56Bk and conveyed to a secondary transfer roller 5 by the rotation of the intermediate transfer belt 3. Image formation process of each color is performed at such a timing that the toner images are transferred onto the intermediate transfer belt 3 so as to be superposed on one another.

In parallel with the image formation process described above, a sheet S supported on an inner plate 8 of one of the cassettes 33 is fed by a feed roller 7 and a separation roller 71. The sheet S fed by the feed roller 7 is conveyed to a registration roller pair 10 by a conveyance roller pair 9.

The registration roller pair 10 corrects the skew of the sheet S and conveys the sheet S at a predetermined conveyance timing. A secondary transfer bias applied to the secondary transfer roller 5 causes a full-color toner image on the intermediate transfer belt 3 to be transferred onto a first surface of the sheet S conveyed by the registration roller pair 10. Residual toner remaining on the intermediate transfer belt 3 is collected by a cleaner 6. The printer 1 also includes a toner supplying portion 4 including toner bottles 4Y, 4M, 4C, and 4Bk that supply toner of yellow, magenta, cyan, and black to the process cartridges 52Y, 52M, 52C, and 52Bk, respectively.

The sheet S onto which the toner image has been transferred is subjected to predetermined heat and pressure applied by a heating roller 11*a* and a pressurizing roller 11*b* of the fixing unit 11, and the toner thereby melts and adheres, i.e. is fixed, to the sheet S. The sheet S that has passed through the fixing unit 11 is discharged to a discharge tray 13 by a discharge roller pair 12.

In the case where images are to be formed on both surfaces of the sheet S, the rotation of the discharge roller pair 12 is reversed after the trailing edge of the sheet S has passed the discharge roller pair 12, and the sheet S is thereby guided to a duplex conveyance path 14 formed in the duplex conveyance unit 18. The sheet S guided to the duplex conveyance path 14 is conveyed to the registration roller pair 10 by conveyance roller pairs 51, 52, and 9, and a toner image is formed on a second surface of the sheet S by the secondary transfer roller 5. Then, the toner image is fixed by the fixing unit 11, and the sheet S bearing images formed on the first surface and the second surface is discharged to the discharge tray 13 by the discharge roller pair 12.

A sheet presence sensor 15 is provided in a vertical conveyance path 63 between the feed roller 7 and the conveyance roller pair 9, and sheet presence sensors 24 and 59 serving as a first detection portion and a second detection portion are provided in the duplex conveyance path 14. In addition, an operation panel 30 is provided in an upper portion of the apparatus body 1A.

Figure 2:
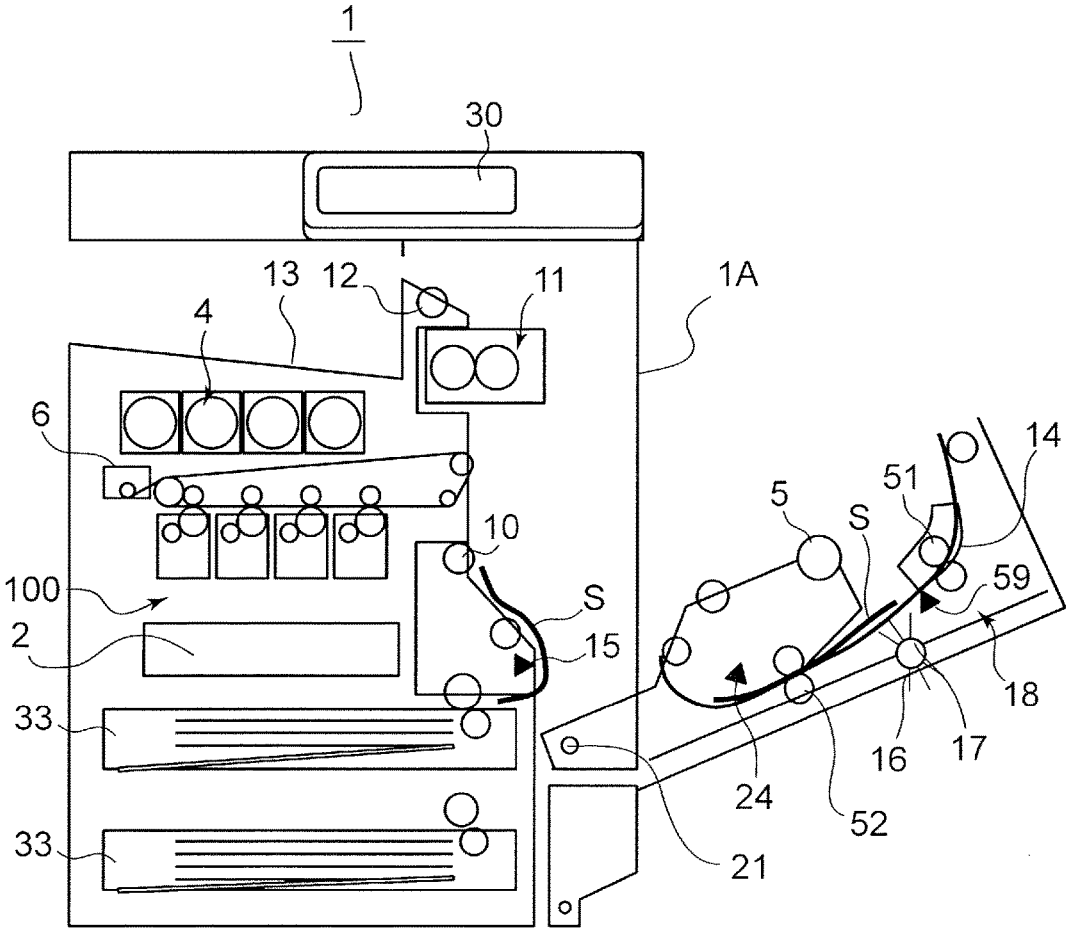
FIG. 2 is a schematic view of an overall structure of the printer in a state where a duplex conveyance unit is at an open position.
Figure 3A:
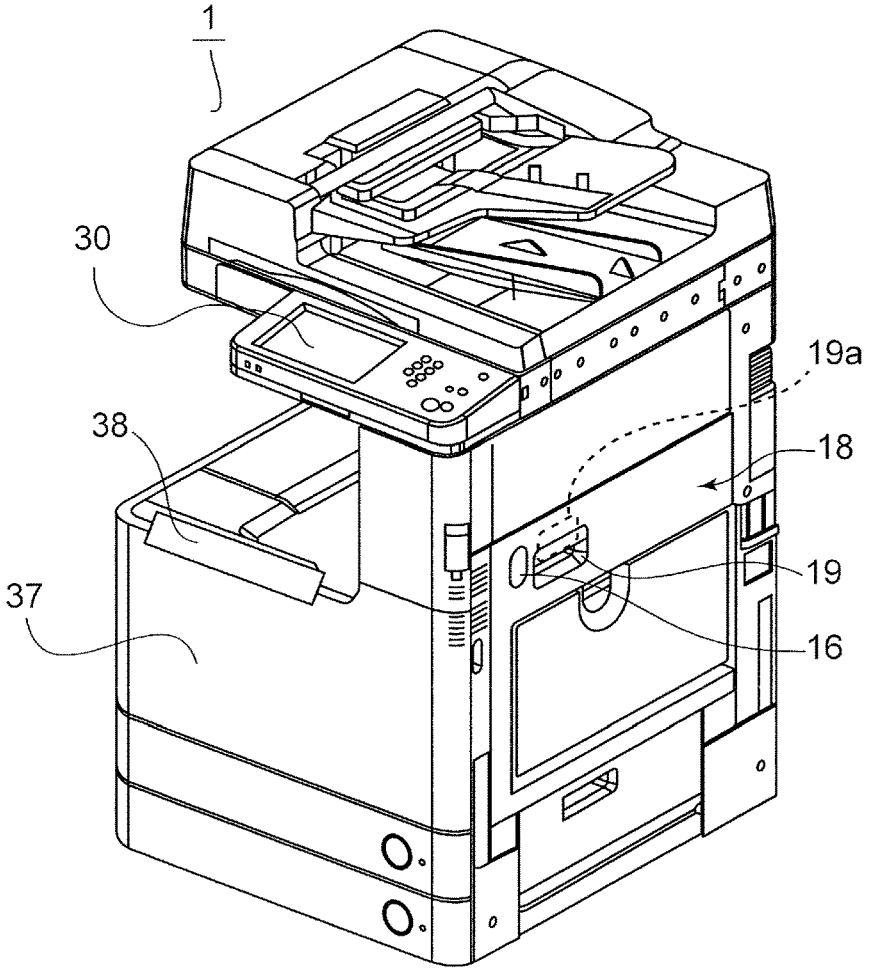
FIG. 3A is a perspective view of the printer as a whole.
Figure 3B:
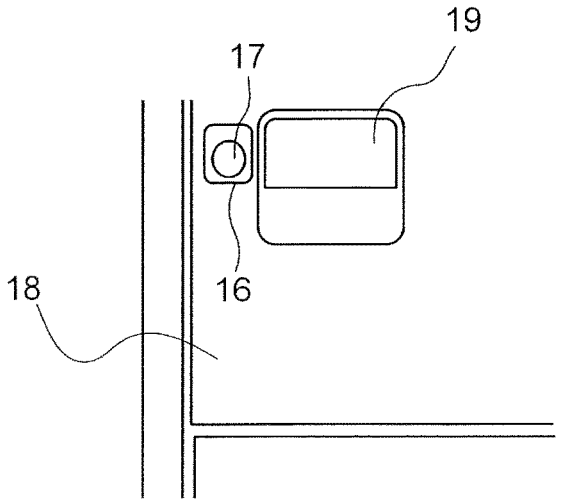
FIG. 3B is an enlarged view of an LED and a handle.

As illustrated in FIG. 2, the duplex conveyance unit 18 is openably and closably supported by the apparatus body 1A between an open position illustrated in FIG. 2 and a closed position illustrated in FIGS. 1 and 3A about a shaft 21. As illustrated in FIGS. 3A and 3B, a user holds a handle 19 and pulls the duplex conveyance unit 18 to move the duplex conveyance unit 18 from the closed position to the open position. A locking mechanism 19*a* that locks the duplex conveyance unit 18 to the apparatus body 1A may be provided, and the lock by the locking mechanism 19*a* may be opened by the user pulling the handle 19 serving as an unlocking portion. A transparent portion 16 is formed in the vicinity of the handle 19 in the duplex conveyance unit 18. The transparent portion 16 is formed of, for example, transparent acryl, and a light emitting diode (LED) 17, which is a light emitting element, is provided inside the transparent portion 16. The transparent portion 16 transmits light emitted by the LED 17.

Figure 4A:
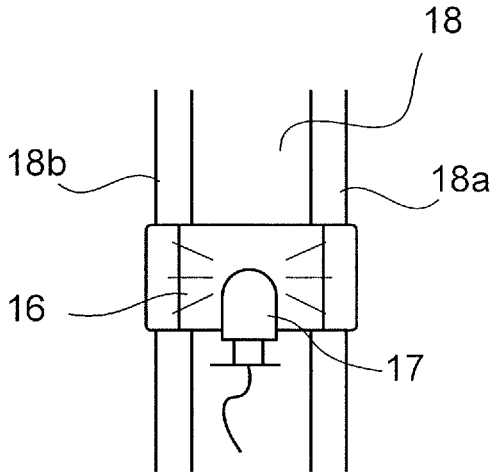
FIG. 4A is a schematic diagram illustrating a transparent portion according to the first exemplary embodiment.
Figure 4B:
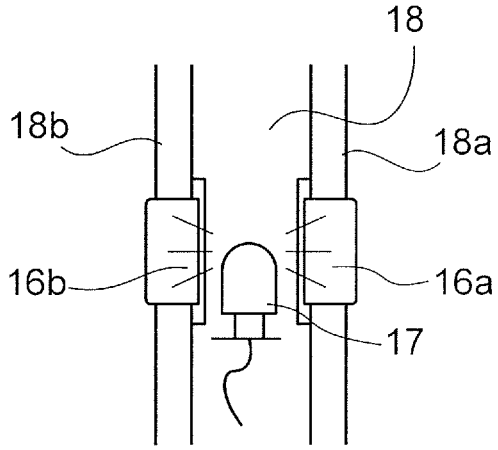
FIG. 4B is a schematic diagram illustrating the transparent portion according to a modification.

In the present exemplary embodiment, as illustrated in FIG. 4A, the transparent portion 16 is disposed so as to extend from an outer surface 18*a*, i.e. an exterior surface, to an inner surface 18*b* of the duplex conveyance unit 18 and is constituted by a material that transmits light. The LED 17 is disposed between the outer surface 18*a* and the inner surface 18*b*, and emits light through the transparent portion 16 in the direction of the outer surface 18*a* and in the direction of the inner surface 18*b*. As illustrated in FIG. 4B, the transparent portion 16 may be constituted by two separate members of a transparent member 16*a* provided in the outer surface 18*a* and a transparent member 16*b* provided in the inner surface 18*b*. Alternatively, the LED 17 may be provided not inside the duplex conveyance unit 18 but on one of the outer surface 18*a* and the inner surface 18*b* of the duplex conveyance unit 18 so as to be exposed, and the transparent portion 16 may be provided so as to extend from the outer surface 18*a* to the inner surface 18*b* such that light is emitted through the transparent portion 16 to the direction of the other of the outer surface 18*a* and the inner surface 18*b* of the duplex conveyance unit 18. In this case, it is particularly preferable that the LED 17 is disposed on the inner surface 18*b* because this reduces the risk of the LED 17 being damaged.

In the present exemplary embodiment, a configuration in which a user sees the light of the LED 17 emitted through the transparent portion 16 has been described as an example. However, a configuration in which a through hole is provided in the duplex conveyance unit 18 in place of the transparent portion 16 and the LED 17 is disposed in the through hole may be alternatively adopted.

Figure 5A:
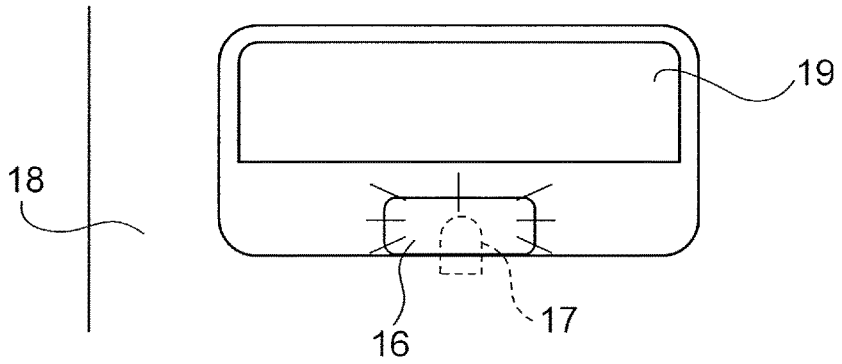
FIG. 5A illustrates an arrangement of the transparent portion and the LED in a modification.
Figure 5B:
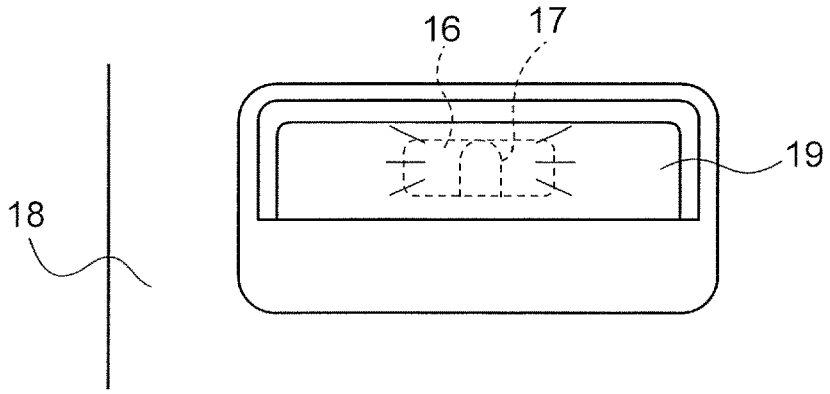
FIG. 5B illustrates an arrangement of the transparent portion and the LED in a modification.
Figure 5C:
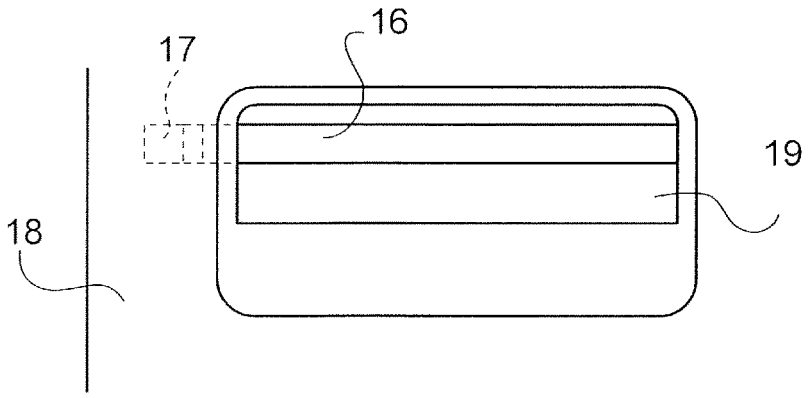
FIG. 5C illustrates an arrangement of the transparent portion and the LED in a modification.

In addition, although the transparent portion 16 and the LED 17 are provided in the vicinity of the handle 19 serving as an operation portion, the arrangement is not limited to this and another configuration may be adopted. For example, an LED 17 may be provided so as to directly irradiate the handle 19 as illustrated in FIG. 5A. For another example, the transparent portion 16 may be formed in the handle 19, and the handle 19 may be irradiated by the LED 17 through the transparent portion 16 as illustrated in FIG. 5B. For yet another example, the LED 17 may be provided in the vicinity of the handle 19, and the transparent portion 16 may be extended so as to guide the light emitted by the LED 17 to the handle 19 as illustrated in FIG. 5C. In any of these cases, the light is emitted from the LED 17 disposed in or in the vicinity of the handle 19 through the transparent portion 16 in a closing direction or an opening direction of the duplex conveyance unit 18, and the light emitted from the LED 17 is visible in both of the state where the duplex conveyance unit 18 is at the open position and the state where the duplex conveyance unit 18 is at the closed position.

That is, in the state where the duplex conveyance unit 18 is at the closed position, the light emitted by the LED 17 is visible through the transparent portion 16 in the outer surface of the duplex conveyance unit 18, i.e. the exterior surface of the duplex conveyance unit 18, illustrated in FIG. 3A. In the state where the duplex conveyance unit 18 is at the open position illustrated in FIG. 2, the light emitted by LED 17 is visible through the transparent portion 16 in the inner surface, which faces the inside of the apparatus body 1A, of the duplex conveyance unit 18. The inner surface of the duplex conveyance unit 18 is an opposite side, with respect to the outer surface 18*a*, of the duplex conveyance unit 18.

Figure 6:
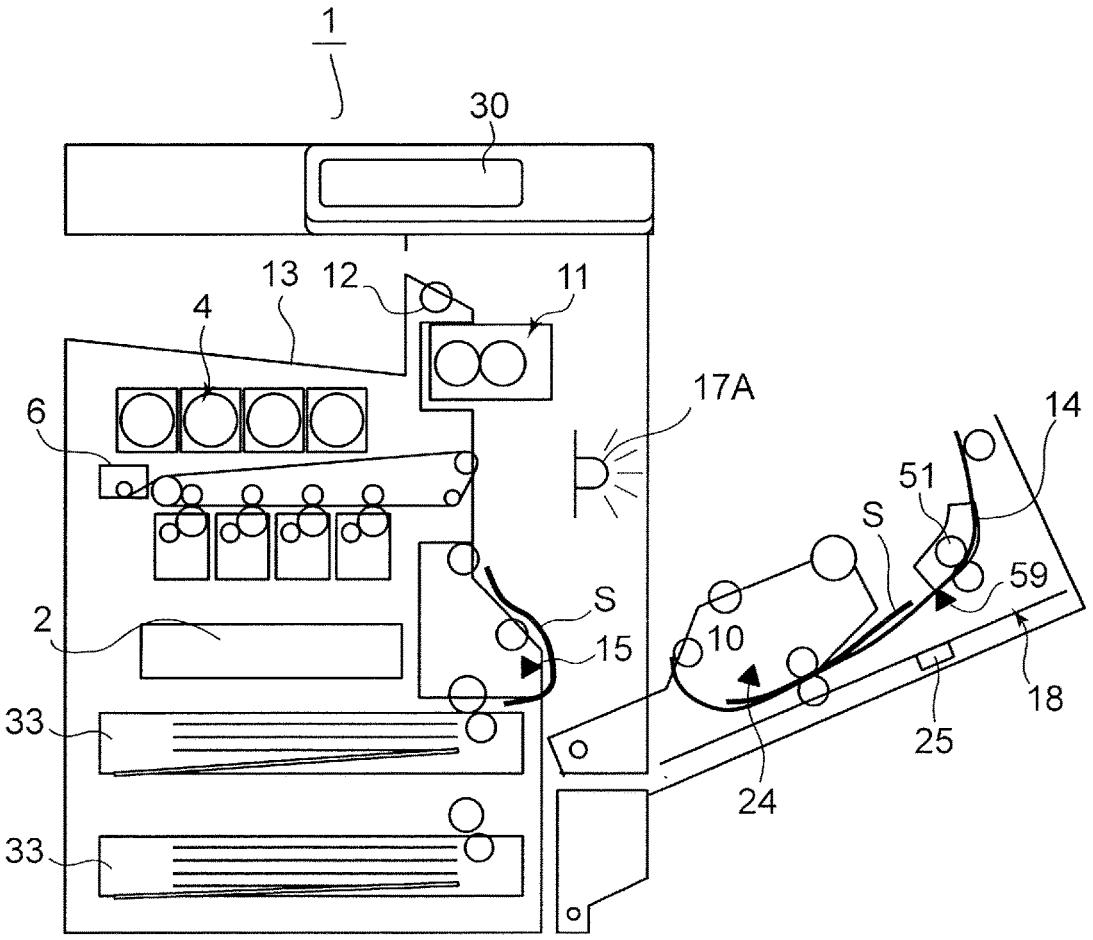
FIG. 6 is a schematic view of an overall structure of a printer according to a modification in which the LED is provided in an apparatus body.
Figure 7A:
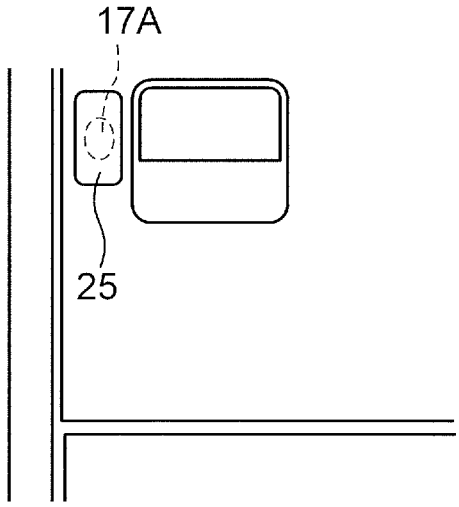
FIG. 7A is an enlarged view of the printer illustrated in FIG. 6 in a state where a duplex conveyance unit is at a closed position.
Figure 7B:
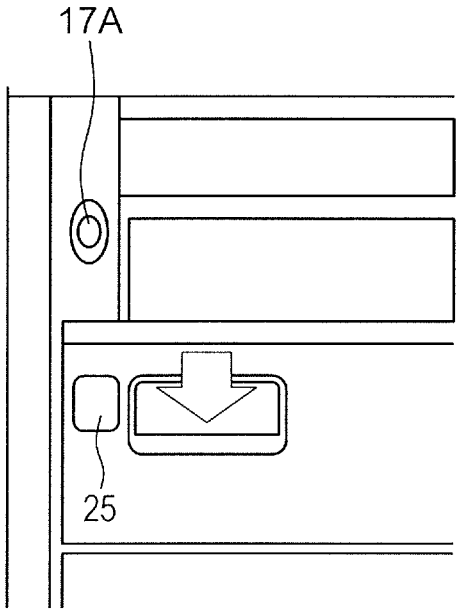
FIG. 7B is an enlarged view of the printer illustrated in FIG. 6 in a state where the duplex conveyance unit is at an open position.

Furthermore, as illustrated in FIGS. 6, 7A, and 7B, an LED 17A may be disposed in the apparatus body 1A instead of providing the LED 17 in the duplex conveyance unit 18. In this case, as illustrated in FIG. 7A, a transparent portion 25 is disposed at a position in the duplex conveyance unit 18 corresponding to the LED 17A. This allows the light of the LED 17A to be emitted through the transparent portion 25 in the opening direction of the duplex conveyance unit 18 in the case where the duplex conveyance unit 18 is at the closed position. In the case where the duplex conveyance unit 18 is at the open position, the user can directly see the light of the LED 17A.

As illustrated in FIG. 8, the duplex conveyance path 14 is formed by a conveyance lower guide 26*b* and a conveyance upper guide 26*a*, i.e. a conveyance guide pair, in the vicinity of the sheet presence sensor 59. The conveyance lower guide 26*b* is integrally formed with the duplex conveyance unit 18, and the conveyance upper guide 26*a* is provided so as to be openable and closable with respect to the conveyance lower guide 26*b*. The conveyance upper guide 26*a* serving as a second opening/closing portion pivots to the open position as a result of the user lifting up a handle 27, and the duplex conveyance path 14 is thereby exposed. The handle 27 serving as a transparent portion is partially or entirely constituted by a material that transmits light.

An LED 28 serving as a second light emitting element is provided on the conveyance lower guide 26*b*, and when the conveyance upper guide 26*a* is at a closed position, the light of the LED 28 is emitted upward such that the light passes through the handle 27 and is visible to the user. At least a part of the handle 27 transmits the light. The light of the LED 28 can be seen not through the handle 27 but directly when the conveyance upper guide is at an open position. It is sufficient as long as the LED 28 is provided on one of the conveyance upper guide 26*a* and the conveyance lower guide 26*b*. Thus, the LED 28 may be provided on the conveyance upper guide 26*a*. That is, the light emitted by the LED 28 is visible from the outside of the apparatus body 1A in a state where the conveyance upper guide 26*a* is at both the closed position and the open position.

Figure 9:
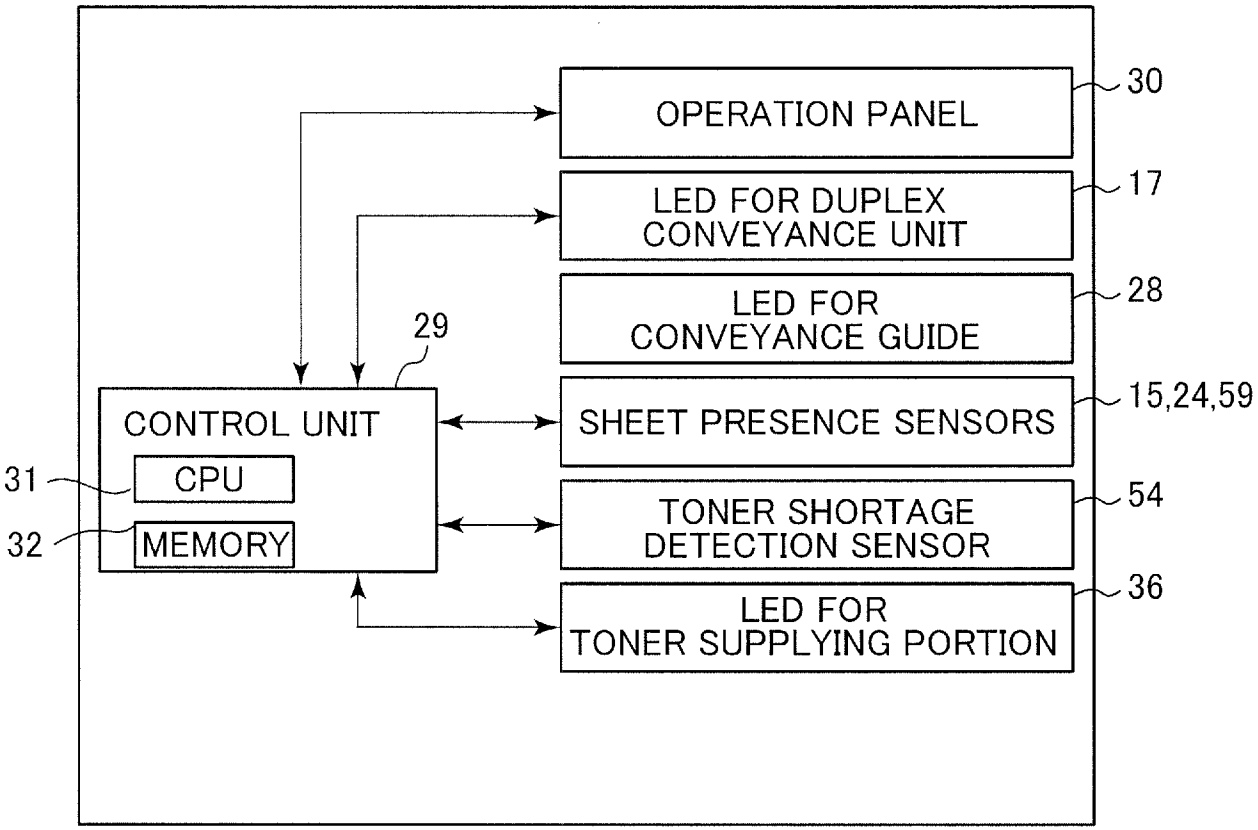
FIG. 9 is a block diagram of a control unit according to the first exemplary embodiment and a second exemplary embodiment.

Next, control according to the present exemplary embodiment will be described with reference to FIG. 9, which is a block diagram. A control unit 29 provided in the printer 1 includes a CPU 31 and a memory 32. The memory 32 stores a program and so forth. The control unit 29 is connected to the operation panel 30, the LEDs 17 and 28, an LED 36, the sheet presence sensors 15, 24, and 59, and a toner shortage detection sensor 54. The toner shortage detection sensor 54 serves as a disabled state detection portion. The LED 36 and the toner shortage detection sensor 54 will be described in the description of a second exemplary embodiment of the present invention.

Figure 10:
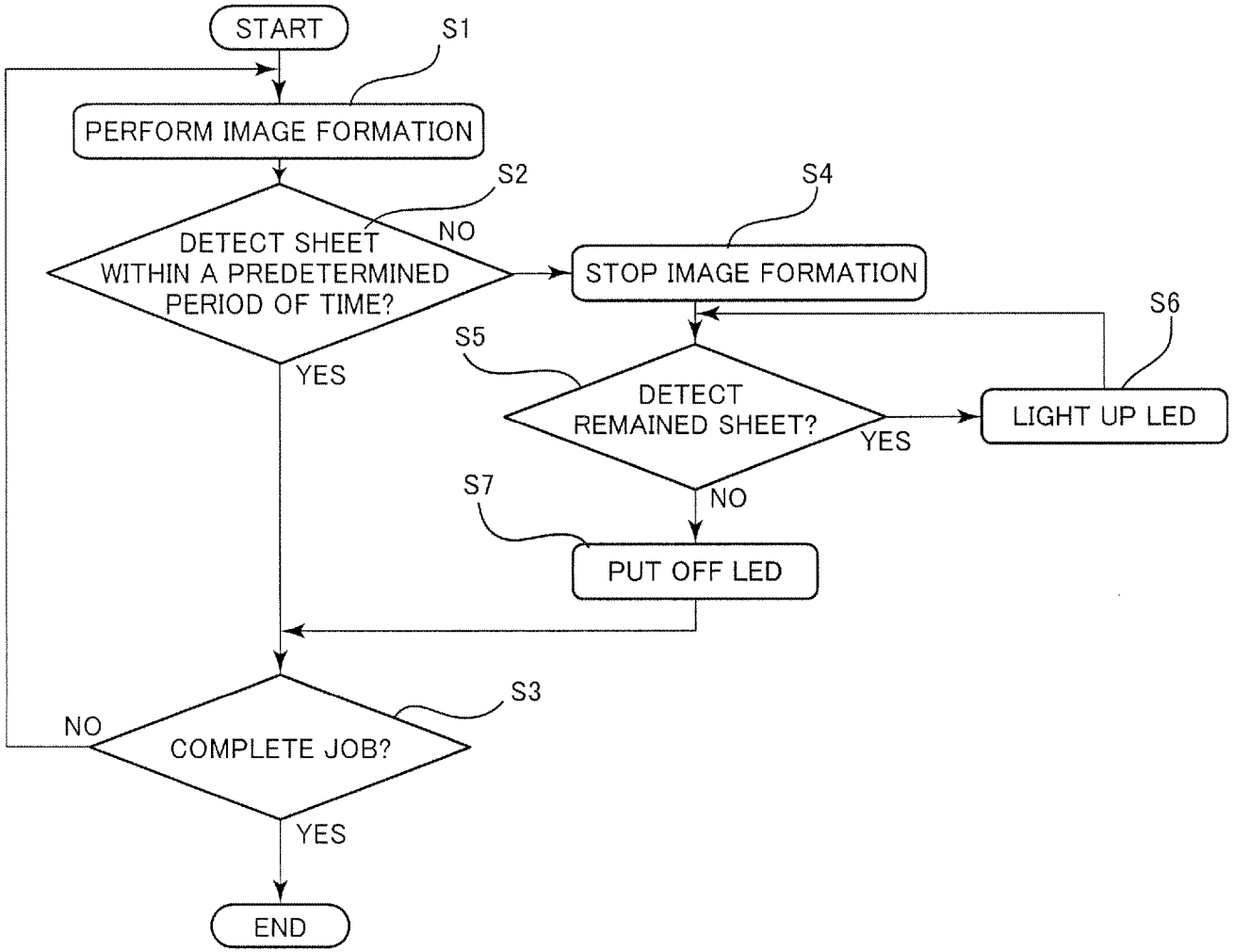
FIG. 10 is a flowchart illustrating image formation control and jam removal control.

Next, jam removal control according to the present exemplary embodiment will be described with reference to FIG. 10. In step S1, the control unit 29 receives instruction to perform image formation from the operation panel 30 or a computer and starts image formation operation by the printer 1. In the image formation operation, the control unit 29 drives the feed roller 7 and feeds a sheet from a cassette 33. In step S2, whether the sheet presence sensors 15, 24, and 59 serving as disabled state detection portions have detected that the sheet has passed within a predetermined period of time is determined. In the case where the result of step S2 is YES, it is determined that the sheet has been conveyed without a jam, and the control proceeds to step S3. In step S3, whether a job has been completed is determined. In the case where the result of step S3 is YES, the control is finished. In the case where the result of step S3 is No, that is, in the case where the job has not been completed, the control goes back to step S1.

In the case where the result of step S2 is NO, that is, in the case where the sheet presence sensors 15, 24, and 59 have not detected that the sheet has passed within the predetermined period of time, it is determined that a jam of the sheet has occurred and the control proceeds to step S4. In step S4, the image formation operation is stopped. The state where the sheet is jammed is an image formation disabled state where an image cannot be formed on the sheet. In step S5, whether the sheet presence sensors 15, 24, and 59 has detected the sheet remaining in the vertical conveyance path 63 or the duplex conveyance path 14 serving as a conveyance path is determined. In the case where the result of step S5 is YES, the control proceeds to step S6. In step S6, the control unit 29 lights up an LED corresponding to the sheet presence sensor that has detected the sheet. That is, as illustrated in FIG. 2, in the case where the sheet presence sensors 15 and 24 have detected the remaining sheet, the LED 17 lights up and the light of the LED 17 is emitted to the outside of the printer 1 through the transparent portion 16, and the user is thereby notified of the occurrence of the jam. It is required to open the duplex conveyance unit 18 in order to remove the sheet remaining in the vertical conveyance path 63 or the duplex conveyance path 14 serving as a conveyance path. The user recognizes the fact that the jam has occurred and that the duplex conveyance unit 18 should be opened in order to remove the sheet remaining in the image forming apparatus due to the jam from the light of the LED 17. The user can see the light of the LED 17 through the transparent portion 16 even in a state where the duplex conveyance unit 18 has been moved to the open position by the user to remove the jammed sheet.

Figures 8A, 8B:
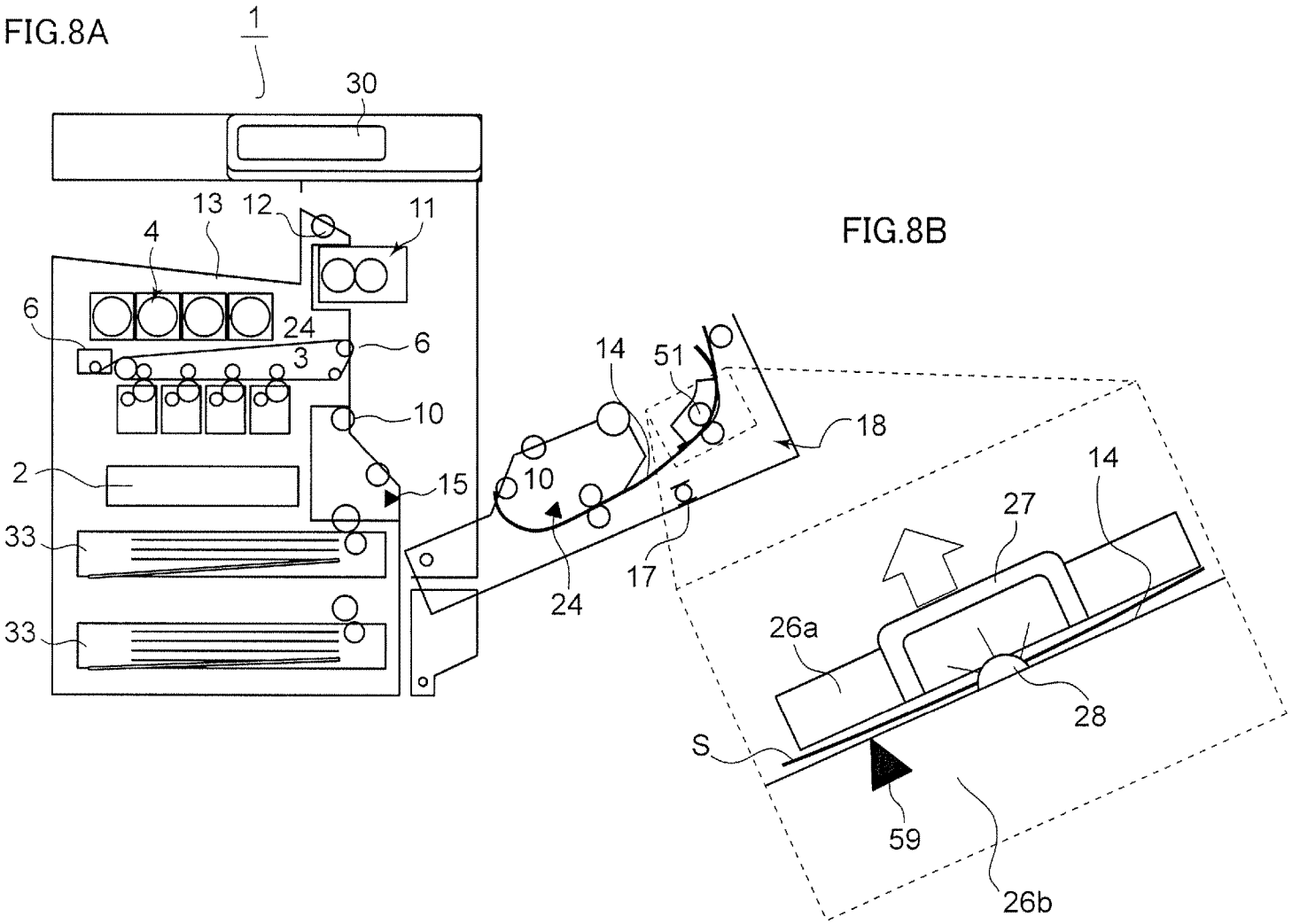
FIG. 8A is a schematic view of upper and lower conveyance guides and the LED disposed at a duplex conveyance path according to the first exemplary embodiment.
FIG. 8B is an enlarged view of the conveyance guides and the LED illustrated in FIG. 8A.

In the case where the sheet presence sensor 59 has detected the remaining sheet as illustrated in FIG. 8B, the control unit 29 lights up the LEDs 17 and 28. The user recognizes the LED 17 from outside the duplex conveyance unit 18 at the closed position and moves the duplex conveyance unit 18 to the open position. In the state where the duplex conveyance unit 18 is at the open position, the light of the LED 28 is emitted upward through the handle 27 that transmits light, and the user thereby sees the light of the LED 28.

Then the user removes the jammed sheet on the basis of the position of the light of the LED that the user has seen. After the jammed sheet has been removed, i.e. an image formation disabled state is cancelled, the sheet presence sensors 15, 24, and 59 no longer detect the remaining sheet, and the result of step S5 becomes NO. In the case where the result of step S5 is NO, the control proceeds to step S7. In step S7, the control unit 29 puts off the light of the LED that has been lit up, and the control proceeds to step S3. In the case where the job has been completed, i.e. the result of step S3 is YES, the control is finished. In the case where the job has not been completed, i.e. the result of step S3 is NO, the control goes back to step S1.

According to the present exemplary embodiment, as described above, the user can see the light of the single LED 17 in both of the case where the duplex conveyance unit 18 is at the open position and the case where the duplex conveyance unit 18 is at the closed position and can efficiently perform the jam removal. This is preferable in terms of operability. In addition, this allows reducing the number of LEDs compared with the case where a plurality of LEDs are provided for a single position such that the user can be notified of the jam in both of the case where the duplex conveyance unit 18 is at the open position and the case where the duplex conveyance unit 18 is at the closed position, and the cost can be thereby cut down. The conveyance upper guide 26a and the LED 28 provided in the duplex conveyance unit 18 also have a similar advantageous effect.

Second Exemplary Embodiment

Next, a printer 101 serving as an image forming apparatus according to a second exemplary embodiment of the present invention will be described with reference to FIGS. 11A to 14C. In the second exemplary embodiment, a state where the toner stored in the toner supplying portion 4 is insufficient is notified to the user via an LED as an image formation disabled state where an image cannot be formed on a sheet. In the description of the second exemplary embodiment, illustration of the same elements as the first exemplary embodiment will be omitted or given by assigning the same reference numerals in the drawing.

Figure 11A:
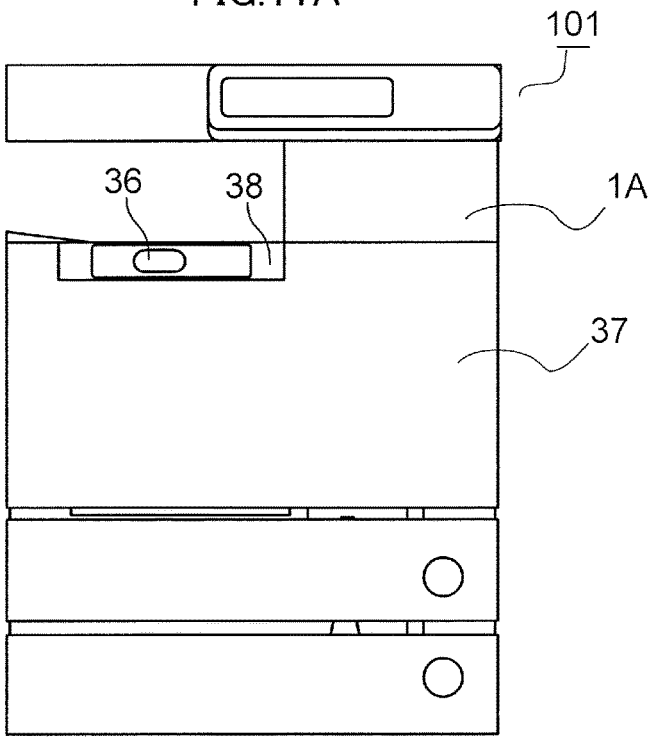
FIG. 11A is a schematic view of a printer according to the second exemplary embodiment as a whole in a state where a front door is at a closed position.
Figure 11B:
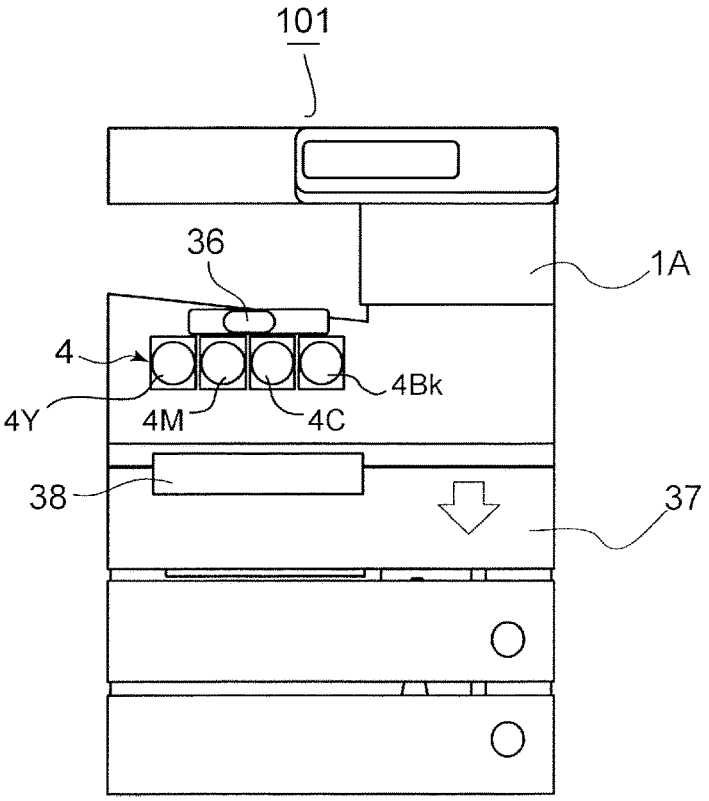
FIG. 11B is a schematic view of the printer according to the second exemplary embodiment as a whole in a state where the front door is at an open position.

As illustrated in FIGS. 11A and 11B, the printer 101 includes a front door 37 supported by the apparatus body 1A so as to be openable and closable. The toner supplying portion 4 is exposed by positioning the front door 37 serving as an opening/closing portion at an open position. The state where the toner stored in the toner supplying portion 4 is insufficient is detected by the toner shortage detection sensor 54 illustrated in FIG. 9. As the toner shortage detection sensor 54, for example, piezo sensors provided at supplying ports of the toner bottles 4Y, 4M, 4C, and 4Bk are used.

An LED 36 serving as a light emitting element is provided above the toner supplying portion 4, and the light of the LED 36 can be seen from the outside no matter whether the front door 37 is at a closed position or the open position due to a transparent portion 38 formed in an upper portion of the front door 37.

Figure 12A:
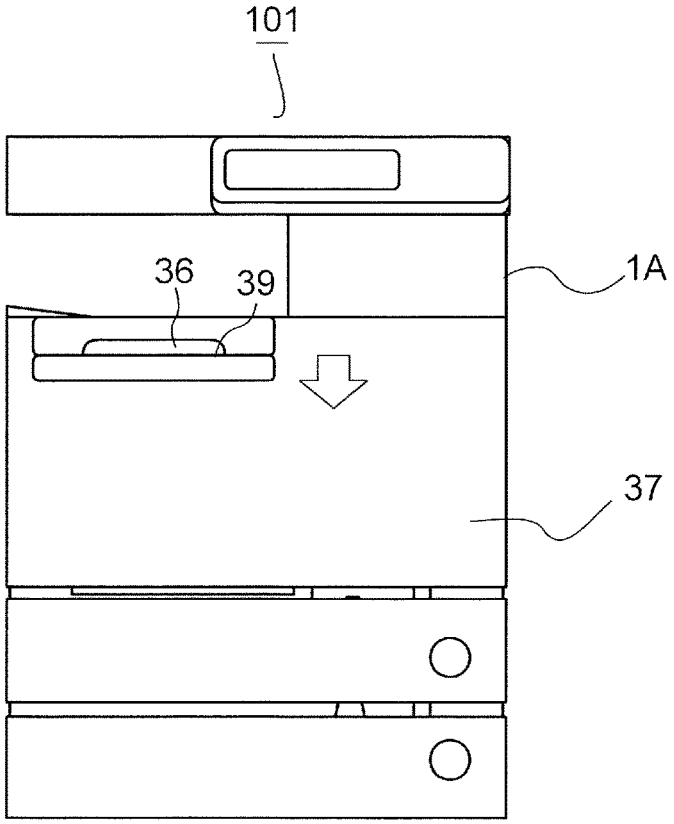
FIG. 12A illustrates an arrangement of the transparent portion and the LED according to a modification.
Figure 12B:
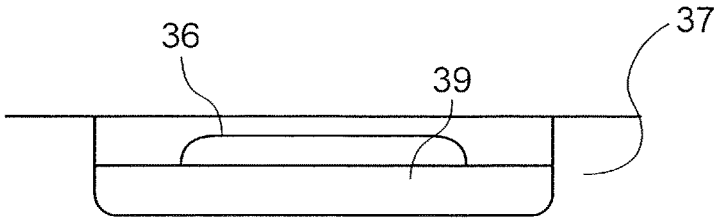
FIG. 12B illustrates an arrangement of the transparent portion and the LED according to a modification.
Figure 12C:
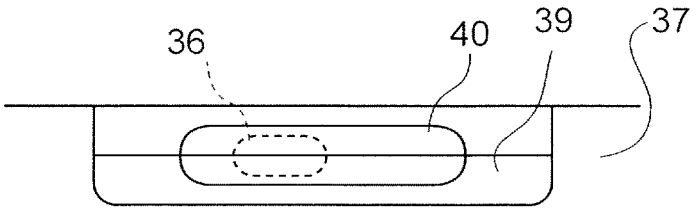
FIG. 12C illustrates an arrangement of the transparent portion and the LED according to a modification.

As a modification of the present exemplary embodiment, the LED 36 may be provided such that the LED 36 directly irradiates a handle 39 of the front door 37 as illustrated in FIGS. 12A and 12B. In addition, a transparent portion 40 formed of a transparent material may be provided in the handle 39 of the front door 37 such that the LED 36 is visible through the transparent portion 40 as illustrated in FIG. 12C.

The control unit 29 lights up the LED 36 in the case where the toner shortage detection sensor 54 detects the state where the toner stored in the toner supplying portion 4 is insufficient. The user can see the light of the LED 36 through the transparent portion 38 in the front door 37 at the closed position and thereby can recognize running out of the toner. The user can see the light of the LED 36 even in the case where the front door 37 is moved to the open position by the user. This prevents the user from forgetting to replenish the toner during the operation. This leads to improvement of operability and maintainability.

Figure 13A:
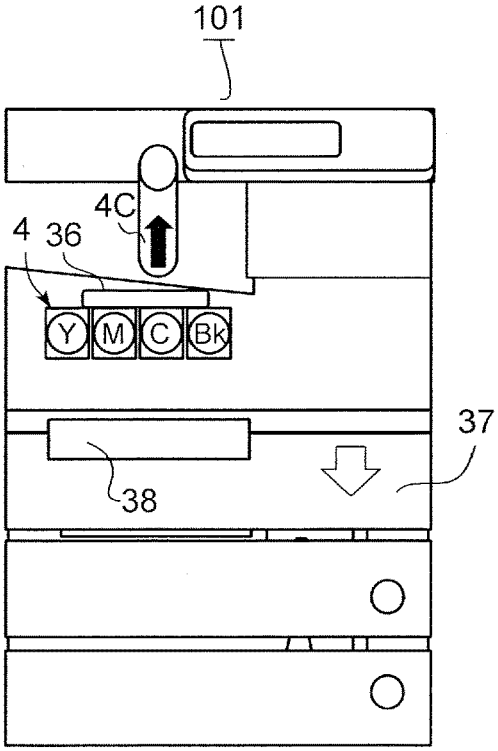
FIG. 13A is a schematic view of a printer as a whole in a state where an old toner bottle has been drawn out from the printer.
Figure 13B:
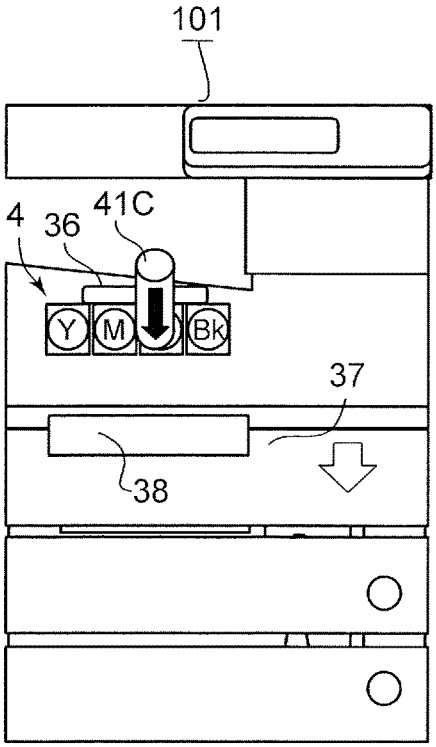
FIG. 13B is a schematic view of the printer as a whole in a state where a new toner bottle is being inserted in the printer.
Figure 13C:
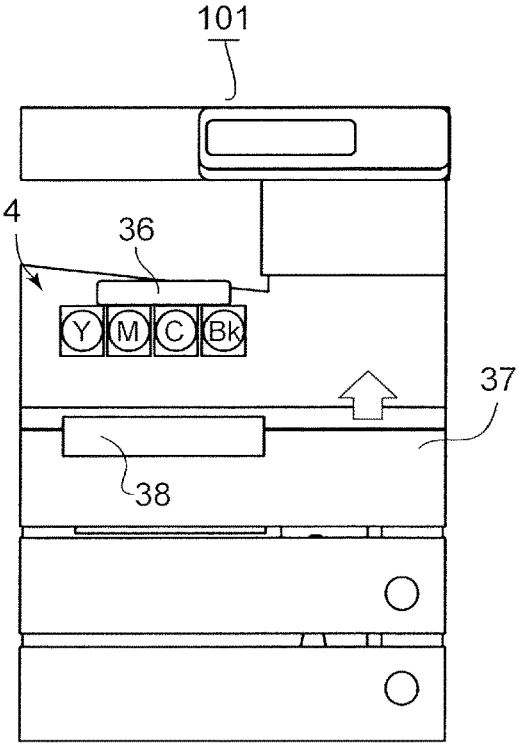
FIG. 13C is a schematic view of the printer as a whole in a state where replacement of a toner bottle has been completed.

Next, procedure of replenishing the toner supplying portion 4 with toner will be described with reference to FIGS. 13A to 13C. For example, in the case where the toner bottle 4C storing cyan toner is empty, the toner bottle 4C is taken out as illustrated in FIG. 13A and replaced by a new toner bottle 41C as illustrated in FIG. 13B. In the case where the new toner bottle 41C is inserted in the toner supplying portion 4, the toner shortage detection sensor 54 detects that the toner supplying portion 4 has been replenished with toner, and the control unit 29 puts off the light of the LED 36. This allows the user to recognize that the toner supplying portion has been replenished with toner, and thereby the user can efficiently replace the toner bottle. Then, the user moves the front door 37 back to the closed position as illustrated in FIG. 13C, and thereby the replenishment with toner is finished.

In addition, although a single LED is disposed for the toner supplying portion 4 in the present exemplary embodiment, the toner bottle of each color may be provided with an LED. That is, LEDs 36Y, 36M, 36C, and 36Bk may be provided at positions visible from the outside through the transparent portion 38 in correspondence with yellow, magenta, cyan, and black toner bottles, respectively, as illustrated in FIG. 14.

Figure 14A:
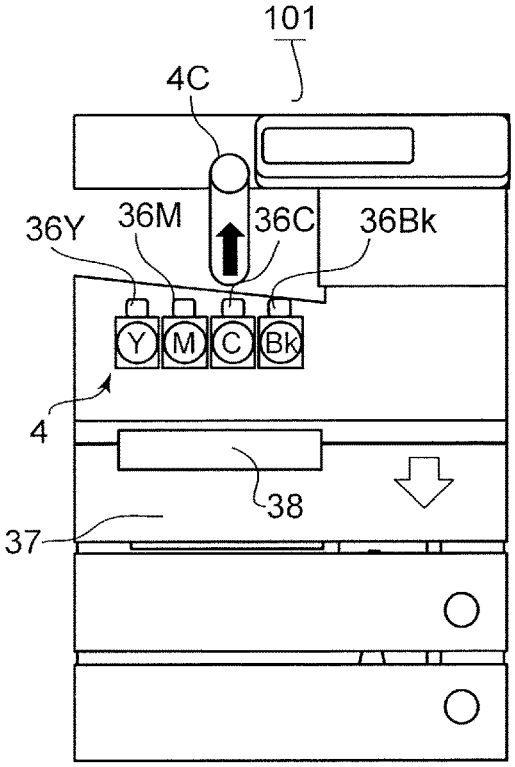
FIG. 14A is a schematic view of a printer according to a modification as a whole in a state where an old toner bottle has been drawn out from the printer.
Figure 14B:
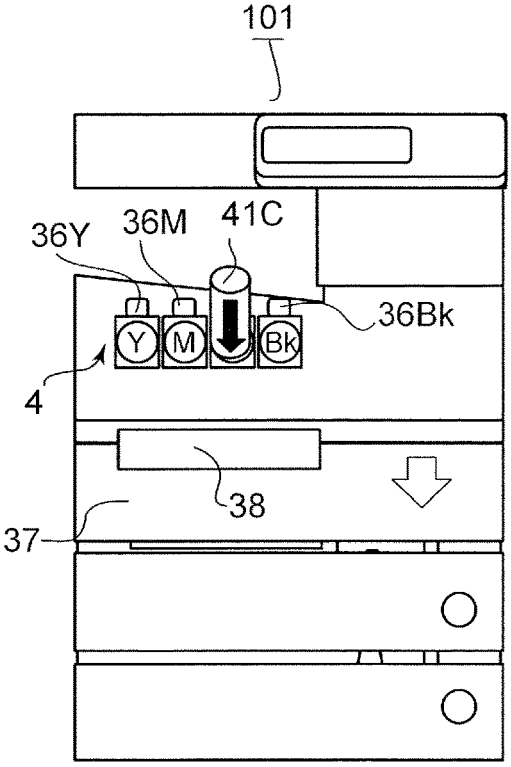
FIG. 14B is a schematic view of the printer according to the modification as a whole in a state where a new toner bottle is being inserted in the printer.
Figure 14C:
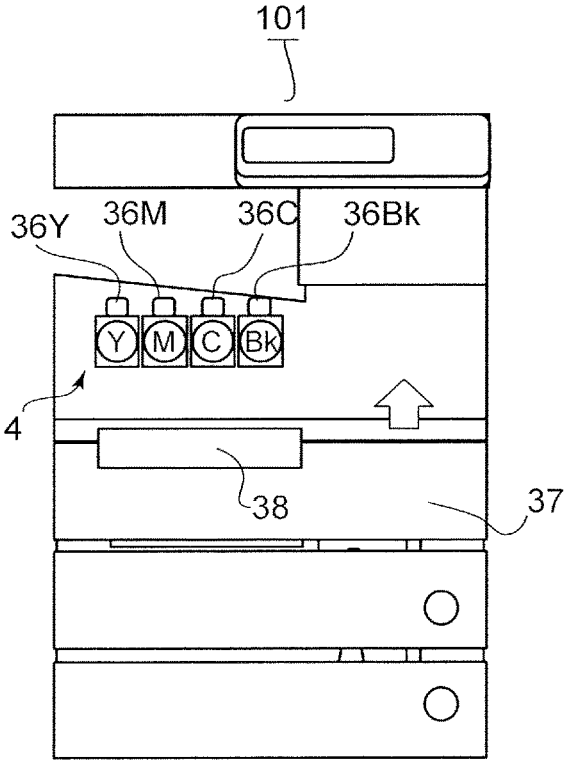
FIG. 14C is a schematic view of the printer according to the modification as a whole in a state where replacement of a toner bottle has been completed.

For example, in the case where the toner bottle 4C storing cyan toner is empty, the control unit 29 lights up the LED 36C on the basis of detection results of the toner shortage detection sensor 54. Then, the user recognizes running out of the cyan toner by seeing the light of the LED 36C, takes out the toner bottle 4C as illustrated in FIG. 14A, and replaces the toner bottle 4C with the new toner bottle 41C as illustrated in FIG. 14B. After the new toner bottle 41C is inserted in the toner supplying portion 4, the toner shortage detection sensor 54 detects that the toner supplying portion 4 has been replenished with toner, and the control unit 29 puts off the light of the LED 36C. This allows the user to recognize that the toner supplying portion has been replenished, and thereby the user can efficiently replace the toner bottle. Then, the user moves the front door 37 back to the closed position as illustrated in FIG. 14C, and thereby the replenishment with toner is finished.

As an aspect of the present invention, the first exemplary embodiment and the second exemplary embodiment may be combined. That is, a printer may light up the LED 17 corresponding to the duplex conveyance unit 18 in the case where a sheet is jammed in the duplex conveyance unit and may light up the LED 36 corresponding to the front door 37 in the case where the toner is insufficient. In other words, this printer lights up light emitting portions, i.e. LEDs 17 and 36, disposed in accordance with opening/closing portions, i.e. the duplex conveyance unit 18 and the front door 37, to be operated by the user. In this case, the printer includes the LED 17 serving as a light emitting element, the LED 36 serving as another light emitting element, the duplex conveyance unit 18 serving as an opening/closing portion, and the front door 37 serving as another opening/closing portion.

The lighting of the LEDs is not limited to continuous lighting and may be a flicker. In addition, although the notification to the user is performed via the LEDs in the first and second exemplary embodiments, the notification to the user may be performed not only via the LEDs but also via the operation panel 30.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-220964, filed Nov. 11, 2015, which is hereby incorporated by reference herein in its entirety.

What is claimed is:

1. An image forming apparatus comprising:

an apparatus body comprising an image forming unit configured to form an image on a sheet;

an opening/closing portion comprising an inner surface and an exterior surface and openably and closably supported by the apparatus body between an open position and a closed position, the inner surface facing the apparatus body in a state where the opening/closing portion is in the closed position, the exterior surface being exposed to an outside of the image forming apparatus in a state where the opening/closing portion is in the closed position; and a light source mounted to the opening/closing portion and configured to emit light in a first direction and a second direction with reference to a posture of the opening/closing portion, the light emitted in the first direction reaching the outside of the image forming apparatus in a state where the opening/closing portion is in the closed position, and the light emitted in the second direction reaching a space between the inner surface of the opening/closing portion and the apparatus body in a state where the opening/closing portion is in the open position.

2. The image forming apparatus according to claim 1, wherein the opening/closing portion comprises a transparent portion configured to transmit the light emitted by the light source in the first and second directions.

3. The image forming apparatus according to claim 2, wherein the light source is disposed between the exterior surface and the inner surface and emits the light through the transparent portion in the first and second directions.

4. The image forming apparatus according to claim 2, wherein the light source is disposed on the inner surface of the opening/closing portion and emits light in the first and second directions.

5. The image forming apparatus according to claim 1, wherein the opening/closing portion comprises an operation portion configured to be operated to open the opening/closing portion, and the light source is disposed in a vicinity of the operation portion.

6. The image forming apparatus according to claim 1, wherein the opening/closing portion comprises an operation portion configured to be operated to open the opening/closing portion, and the light source is disposed in the operation portion.

7. The image forming apparatus according to claim 1, further comprising a conveyance guide pair configured to guide the sheet on which the image has been formed by the image forming unit back toward the image forming unit again, wherein one conveyance guide member of the conveyance guide pair is provided in the opening/closing portion and the other conveyance guide member of the conveyance guide pair is provided in the apparatus body.

8. The image forming apparatus according to claim 1, further comprising:

a disabled state detection portion configured to detect an image formation disabled state in which image formation on the sheet is disabled; and a control unit configured to cause the light source to emit the light in a case where the image formation disabled state has been detected by the disabled state detection portion, and to cause the light source to stop emitting the light in a case where the disabled state detection portion has detected cancellation of the image formation disabled state.

9. The image forming apparatus according to claim 8, further comprising a conveyance path configured to guide the sheet on which the image is to be formed by the image forming unit and configured to be exposed in the state where the opening/closing portion is in the open position, wherein the image formation disabled state includes a state in which the sheet is jammed in the conveyance path.

10. The image forming apparatus according to claim 8, further comprising a toner supplying portion configured to store toner and supply the toner to the image forming unit, wherein the image formation disabled state includes a state in which the toner stored in the toner supplying portion is insufficient.

11. The image forming apparatus according to claim 1, wherein the light source is a light emitting diode.

12. The image forming apparatus according to claim 1, wherein the opening/closing portion comprises a first opening/closing portion, and the light source comprises a first light source, the image forming apparatus further comprising:

a second opening/closing portion openably and closably supported between an open position and a closed position;

a second light source configured to emit light such that the light emitted by the second light source is visible from the outside of the image forming apparatus in a state where the second opening/closing portion is at either of the closed position and the open position;

a first detection portion configured to detect that the sheet has been jammed in a first conveyance path partially formed by the first opening/closing portion;

a second detection portion configured to detect that the sheet has been jammed in a second conveyance path partially formed by the second opening/closing portion; and a control unit configured to cause the first light source to emit the light in a case where the first detection portion has detected a jam of the sheet, and to cause the second light source to emit the light in a case where the second detection portion has detected the jam of the sheet.

13. The image forming apparatus according to claim 1, further comprising a control unit configured to cause the light source to emit light in accordance with an occurrence of a jam of the sheet at a position which requires the opening/closing portion to be in the open position so as to remove the jammed sheet, and configured to cause the light source to stop emitting the light in a case where the jammed sheet has been removed in a state in which the opening/closing portion is in the open position.

14. The image forming apparatus according to claim 1, wherein the light source is mounted to the opening/closing portion between the exterior surface and the inner surface, the first direction is a direction toward the exterior surface, and the second direction is a direction toward the inner surface.

15. The image forming apparatus according to claim 14, wherein the opening/closing portion comprises a transparent portion configured to transmit the light emitted by the light source in the first and second directions, the transparent portion comprises a first surface which constitutes the exterior surface of the opening/closing portion, and a second surface which constitutes the inner surface of the opening/closing portion, and the light source is disposed between the first surface and the second surface.

16. The image forming apparatus according to claim 1, wherein the light source is configured to emit light due to electric current flowing through the light source.

* * * * *